US005857806A

United States Patent [19]

Melin

[11] Patent Number: 5,857,806

[45] Date of Patent: Jan. 12, 1999

[54] LIQUID DAMMING PROTECTIVE BANK AS WELL AS A METHOD AND A DAMMING DEVICE FOR ERECTING SUCH A PROTECTIVE BANK

[76] Inventor: Sigurd Melin, Veda, Näsviken, Sweden, S-820 64

[21] Appl. No.: 894,972

[22] PCT Filed: Feb. 29, 1996

[86] PCT No.: PCT/SE96/00258

§ 371 Date: Sep. 2, 1997

§ 102(e) Date: Sep. 2, 1997

[87] PCT Pub. No.: WO96/27710

PCT Pub. Date: Sep. 12, 1996

[30] Foreign Application Priority Data

Mar. 3, 1995 [SE] Sweden ..... 9500795

[51] Int. Cl.[6] ..... E02B 7/20; E02B 3/00

[52] U.S. Cl. ..... 405/115; 405/16; 405/21; 405/91; 405/114

[58] Field of Search ..... 405/15, 16, 21, 405/28, 29–35, 114, 115, 52, 73, 74, 91

[56] References Cited

U.S. PATENT DOCUMENTS

| | | | |
|---|---|---|---|
| 3,080,124 | 3/1963 | Rathmann | 405/45 X |
| 3,246,474 | 4/1966 | Mesnager . | |
| 3,373,568 | 3/1968 | Hornbostel | 405/21 |
| 3,855,800 | 12/1974 | Ganzinotti . | |
| 4,299,514 | 11/1981 | Muramatsu et al. | 405/115 |
| 4,799,821 | 1/1989 | Brodersen | 405/115 |
| 4,906,134 | 3/1990 | Hoyeck . | |
| 4,966,491 | 10/1990 | Sample | 405/21 X |
| 4,981,392 | 1/1991 | Taylor | 405/21 X |
| 5,040,919 | 8/1991 | Hendrix . | |
| 5,059,065 | 10/1991 | Doolaege | 405/115 |
| 5,125,767 | 6/1992 | Dooleage . | |
| 5,158,395 | 10/1992 | Holmberg | 405/15 X |
| 5,743,674 | 4/1998 | Healy | 405/52 |

FOREIGN PATENT DOCUMENTS

| | | |
|---|---|---|
| 0496519 | 7/1992 | European Pat. Off. . |
| 1375854 | 8/1963 | France . |

*Primary Examiner*—Dennis L. Taylor
*Attorney, Agent, or Firm*—Dilworth & Barrese

[57] ABSTRACT

A liquid-damming protective bank comprises a member abutting against a surface upon which a vertical force acts with the purpose of pressing and anchoring the same against the surface. The bank member has a first long side edge turned towards a flood side and an opposite long side edge turned towards a dry side of the protective bank. Between the surface (2) and the bank member (1) there is applied a device (12) extending axially along the bank, e.g. a mat, the purpose of which is to drain away flood liquid possibly leaking in under the member from the flood side so as to keep the area on the bottom side of the member elongating from the long side edge of the draining device (12) being closest to the flood side to the dry side, at or close to atmospheric pressure in order to obtain a maximum pressure difference in relation to the hydraulic pressure keeping the protective bank sealing against the surface.

11 Claims, 3 Drawing Sheets

LIQUID DAMMING PROTECTIVE BANK AS WELL AS A METHOD AND A DAMMING DEVICE FOR ERECTING SUCH A PROTECTIVE BANK

BACKGROUND OF THE INVENTION

In a first aspect, this invention relates to a liquid-damming protective bank of the kind which comprises a member, e.g. a flexible, liquid-filled casing and/or a flexible skirt, abutting against a surface, e.g. the ground, upon which a vertical force acts with the purpose of pressing and anchoring the same against the surface, said protective bank having a first long side edge turned towards a flood side and an opposite, second long side edge turned towards a dry side of the bank.

Phenomena of flood may occur in very different areas and under very different circumstances. A frequent type of flood may hit houses situated in the vicinity of watercourses, e.g. lakes and rivers, temporarily overflowing their banks due to extreme precipitation. Water may then flow by surface over the ground to the house and cause various damage thereto, such as filling possible basement spaces with water or partial filling of localities on the ground floor. Water damage of this type are without exception very costly to master. In other cases, fluids of another type than water, e.g. oil, fuels, chemicals and the like, may spill over on areas or surfaces as a consequence of a leakage of an unexpected type.

Regardless of the type of the flood, there is a general ambition to try to countercheck the flood and to confine the proportions thereof, more precisely by erecting some type of protective bank which stems the liquid flow. The house-owner erects a bank surrounding the house with the purpose of preventing the water from approaching the same. Inversely, in case of a leakage, the protective bank is erected with the purpose of preventing the liquid from distancing from the source of leakage.

Conventional methods for erecting protective banks make use of solid materials, usually of a mineral nature. A common way is to manually lay out sandbags in more or less high rows. Another way is to erect banks of soil by means of suitable machines. However, these methods have disadvantages. To the extent that mechanical dredging or excavation is possible at all, the method is time-wasting and most often only possible to resort to at a late stage. Furthermore, it rather often causes pits and other wounds in the ground. The sandbag method is not only time-wasting but also laborious. Many times, neither machines nor sandbags are available in the immediate surroundings of the flood, and therefore time-consuming transportations have to be carried out before the erection of the bank can be started. This means that the protective bank may be in place too late.

With the purpose of obviating the disadvantages associated with earth banks and protective banks of sandbags respectively, it has lately been developed protective banks erected of mobile damming devices in the form of hose-like casings which may be stored, handled and transported in a collapsed state and filled with liquid, usually water, at the very site of a flood. Examples of such hose-casings are disclosed in abundance in the literature of patents. See, e.g. FR 1 375 854, EP 496 519, U.S. Pat. No. 3,246,474 , U.S. Pat. No. 3,855,800 , U.S. Pat. No. 4,799,821 and U.S. Pat. No. 5,040,919. A substantial advantage of such hose-casings is that they are diminutive in a collapsed state, at the same time as the weighty material which is required for anchoring the casings in a protective bank, usually is available in abundance at the site of the flood in the form of water. Well-nigh unlimited amounts of damming devices in the form of hose-casings may therefore quickly and smoothly be brought to a place hit by a flood and activated on site by the simple measure of filling the same with water. The majority of the previously known damming devices in the form of hose-casings also comprise a skirt turned towards the flood side, of more or less explicit width, most commonly being anchored by means of nail- or stud-like anchoring members, the purpose of which is to seal against the surface.

Another mobile damming device, commercially available under the trade mark of PORTADAM, makes use of an impermeable, skirt-like membrane abutting with a long side portion along the surface, having an opposite long side portion abutted against a framework erected in the line of defence and consisting of a plurality of oblique support legs.

One thing that the previously known protective banks using mobile or portable damming devices have in common, is that the member of the protective bank abutting against the surface is brought to abut against the same over its entire area in the praiseworthy purpose of obtaining the biggest possible tightness against the surface. Thus, the previously known constructions originate from the fundamental idea that the larger the area of contact against the surface, the more reliable becomes the protective bank. However, this fundamental idea is partly based on erroneous premises. Namely, if water, as often is the case in practice, after all starts to leak in under e.g. a skirt kept pressed against the surface by the hydraulic pressure acting on the top side of the skirt, the pressure difference between the top side and the bottom side of the skirt will be substantially reduced. This means that the area of the skirt influenced from below by the same hydraulic pressure as the top side, will lose its anchoring ability. If seepage water under hydraulic pressure is spread out under the skirt and/or the hose-casing all the way from the flood side to the dry side, the protective bank will gradually lose its anchoring ability and thereby its sealing ability against the surface, and finally be loosened from its line of defence. The same reduction of pressure difference exists, of course, also in those cases when a hose-casing without a skirt (see e.g. EP 496 519) is used to erect the protective bank. As soon as water starts to leak in under the surface of the hose-casing abutting against the ground, the total anchoring ability is gradually reduced, meaning that, in a state when the horizontal displacement force from the flood water exceeds the anchoring force, the casing simply floats away on the water lying under the same.

In this context, it should also be pointed out that flood water may find its way down in voids in the ground, under the surface thereof, and subsequently reappear on the surface and exert a lifting pressure against the bottom side of the protective bank.

SUMMARY OF THE INVENTION

The present invention aims at obviating the above-mentioned disadvantages of the previously known protective banks and at creating an improved protective bank. Thus, a primary object of the invention is to create a good anchoring ability of the protective bank, even if flood water tends to start leaking in under the member of the protective bank abutted against the surface.

In a second aspect, the invention furthermore aims at creating a method for erection of a protective bank possible to anchor reliably.

In a third aspect, the invention also aims at creating a mobile damming device by means of which protective banks, possible to anchor reliably, may be erected in an easy and quick manner.

The invention is based on the understanding that the protective bank is assured a continuous anchoring ability, provided that drainage means are inserted between the surface and the member of the bank which abuts against the same, said means guaranteeing that the area of contact between the member and the surface is kept partially "dry" or at atmospheric pressure. In other words, the drainage means ascertains that possible flood water leaking in does not spread over the entire contact area against the surface.

DESCRIPTION OF PREFERRED EMBODIMENTS

Figure 1:
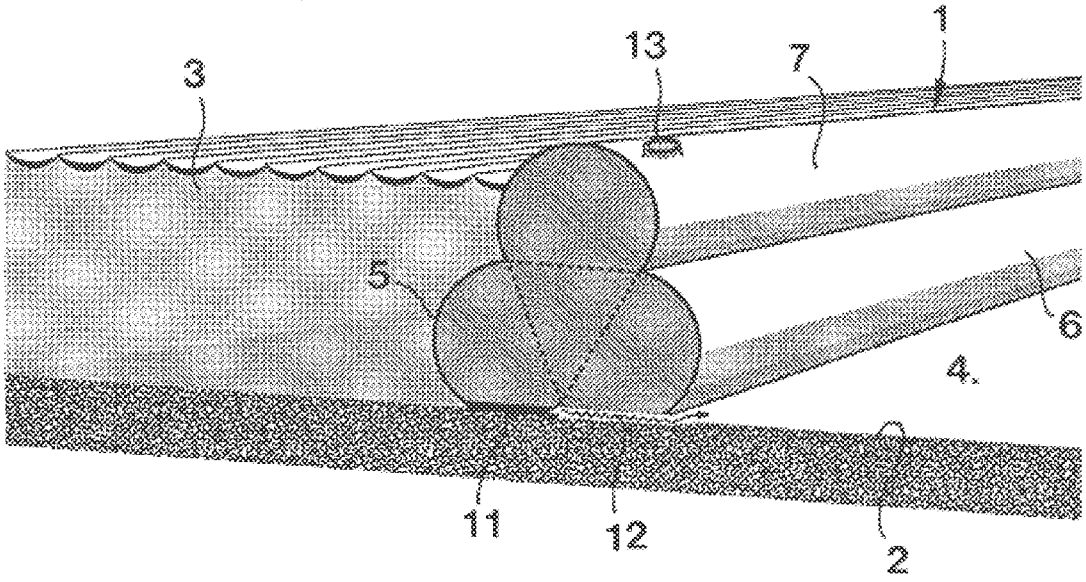
FIG. 1 is a perspective view of a flood protecting bank erected of damming devices according to the invention, more precisely in the form of hose-like casings one of which is shown in a cut state in the figure.

In FIG. 1, reference numeral 1 generally designates a damming device made according to the invention in the form of a hose-casing, which is shown placed on a surface designated 2, with the purpose of stemming a mass of water or fluid 3. In practice, the surface 2 usually consists of the ground, e.g. adjacent to a house. This ground may be even as well as uneven. The dry side of the ground which is found to the right of the casing 1 is designated 4.

Figure 2:
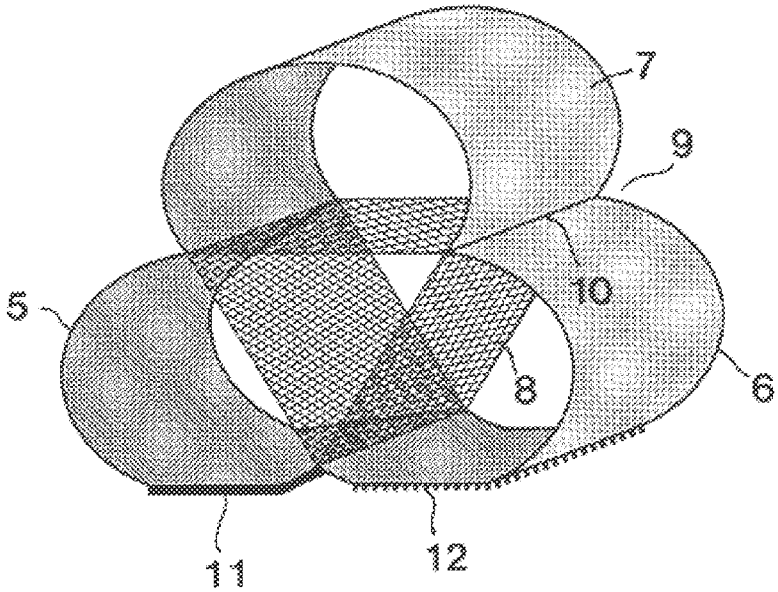
FIG. 2 is an enlarged perspective view of a shorter section of the hose-casing according to FIG. 1.

The casing 1 includes three different sections 5, 6 and 7 which are kept together by means of internal, flexible connecting elements 8. In FIGS. 1 and 2, the sections designated 5 and 6 are shown turned downwardly to the ground, these specific sections forming a pair of base sections located side-by-side on the surface at the same time as the third section 7 is located over and between the base sections 5, 6.

The uniting connecting elements 8 may, in practice, be realized in different ways. In the example according to FIG. 2, nets or perforated fabrics are shown cross-section-wise forming a triangular configuration, and being meant to extend axially along the entire part of the casing having a three-leaf clover-like cross-section. In this context, it should be pointed out that the casing does not have to be provided with this three-leaf clover-like cross-section along its entire length extension. On the contrary, the casing may successively change, at its two opposite ends, from the three-leaf clover cross-section into an increasingly round cross-section. In these narrowing end sections, the connecting elements 8 may either be kept or be spared. Instead of nets or perforated fabrics, other elements could also be used, such as axially separated sets of band or straps, each of which includes three triangulated arranged units. The only important thing is that the connecting elements allow free passage of the filling liquid in question to and between the different sections of the casing.

The casing itself is made of impermeable fabric, e.g. of the type which is commercially available under the designation geomembrane. Thanks to the connecting elements 8, contracted flute-shaped areas 9 are developed between the different sections 5, 6, 7 adjoining the axial boundary lines 10 thereof in the area between two adjacent sections. The casing may be composed of three separate, elongated fabrics, attached to each other along their long side edges while forming said boundary lines 10. However, it is also possible to make the casing of a tubular starting material, on the inside of which the connecting elements 8 are attached in a suitable way. In its active, liquid-filled state, each individual casing section receives, along the major part of its circumference, a round, in particular an elliptic cross-section, with the exception of the bottom parts of the two base sections which are flattened in the loaded state.

The different sections of the casing have three different main functions. The function of the first base section 5 turned towards the flood side, is to seal against the ground, while the second base section 6, which is turned towards the dry side 4, executes an anchoring function. The main function of the third, central and upper section 7, is to dam, i.e. to give the casing in its entirety, the optimum height above the surface. By the fact that the construction is wider in its base section than in its top section, it will have a form stability of its own. Furthermore, the area of contact to the mass of water 3 will slope and thereby the pressure of the flood water gives rise to a vertical, downward compressive component force contributing, in addition to the filling liquid in the casing, to the anchoring of the construction in its entirety.

Underneath the first base section 5 a special sealing layer 11 is arranged. This layer consists of a sealing material of a suitable type, e.g. foam rubber, preventing or obstructing water from passing through the pores and voids which are created between the casing section 5 and the more or less uneven ground surface. Instead of rubber other materials are also conceivable, e.g. in the form of a bentonite mat, i.e. a mat containing a clay material which expands in contact with water.

Under the second base section 6 there is, according to the invention, a special draining means 12. This draining means may be in the form of a layer consisting of a profiled, perforated or porous material, e.g. a draining mat (PLATON-mat, Pac Drain). Further, it is conceivable to arrange special spacers of a suitable shape underneath said base section 6. The draining means 12 may also consist of another large-area unit, such as a flexible mat or a stiff board, having channels or voids between its top and bottom sides through which water may pass in the direction away from one long side edge of the unit towards the opposite. By the fact that the unit has a certain thickness, the base section 6 lying above will be held at a certain level above the surface. In practice, a sandwich construction is preferred as a draining unit which includes upper and lower layers of so called geotextile (a textile material made up of polymer fibres) and an intermediate core of a rigid or semi-stiff material, in particular plastic, which has been provided with a plurality of cup-like projections, similar to the bottom of an egg carton. At the same time as this core is capable of carrying substantial weights, it permits a free passage of liquid between the projections.

In FIG. 1 it is outlined how the casing 1 has a hole 13 for filling of liquid and evacuation of possibly occuring confined air. This hole should be arranged in the vicinity of the end of the casing together with an analogous hole at the opposite end of the casing. There may be one or more additional holes (not shown) also in the area between the ends of the casing. In practice, the holes are, of course, provided with suitable valves or couplings which can be opened and closed.

Figure 3:
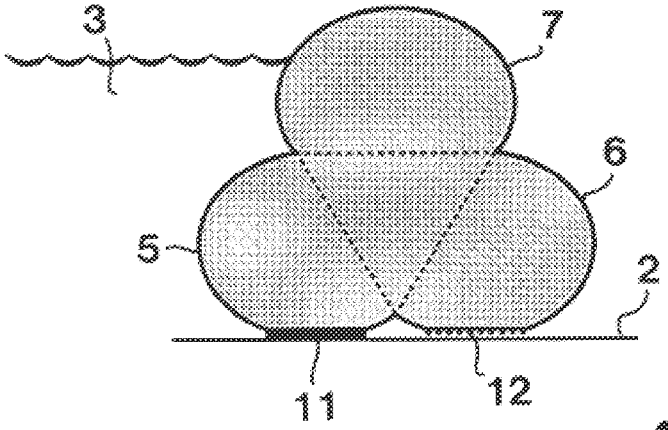
FIG. 3 is a schematic cross-section through the casing according to FIGS. 1 and 2, and FIG. 4 to 8 are analogous cross-sections showing alternative embodiments of the invention.

The protective bank erected according to FIGS. 1 to 3 functions in the following way. After the individual hose-casings of the protective bank have been placed in a desired line of defence and filled with water, the individual casing will be kept pressed against the ground by a force corresponding to the weight of the water encased in the casing. In doing so, the layer 11 acts to seal, while the unit 12 acts to drain. Therefore, if the flood water 3 would start to leak in under the sealing layer 11 and completely pass the area of contact against the ground of said layer, the draining unit 12 guarantees that passed water is quickly drained away in the direction of the dry side of the protective bank. In that way, atmospheric pressure, or at least a pressure which is close to the atmospheric pressure, is maintained at the bottom side of the base section 6. This means that the anchoring force which the base section 6 exerts to the ground is maintained, in spite of the fact that leaking water has passed the sealing layer 11. In other words, the draining unit 12 guarantees a reliable anchoring of the protective bank in its entirety.

Figure 4:
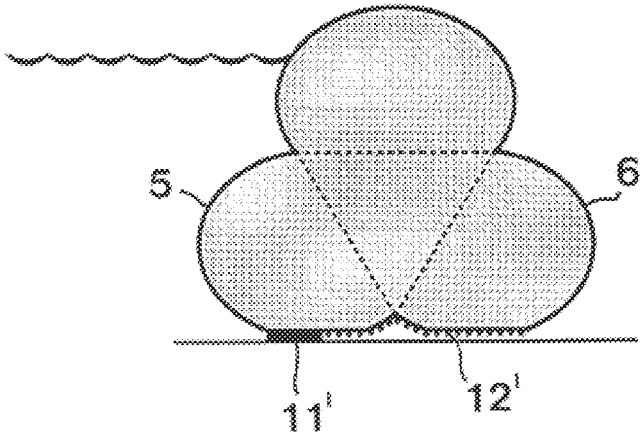

Reference is now made to FIG. 4 which illustrates how a draining layer 12' can be made considerably wider than a sealing layer 11'. Thus, the draining layer 12' extends, in the embodiment according to FIG. 4, not only along the entire bottom side of the base section 6, but also along a certain part of the bottom side of the base section 5.

Figure 5:
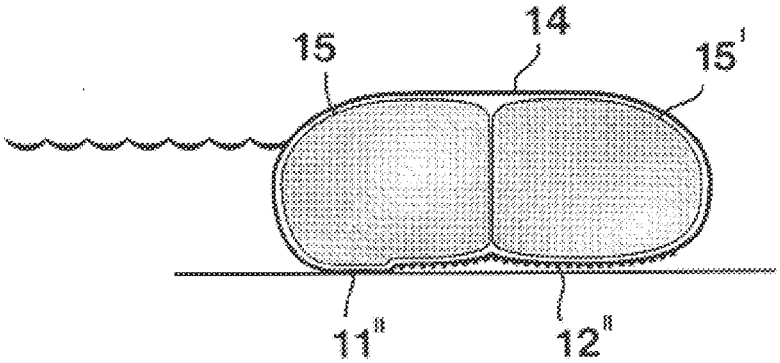

In FIG. 5 a hose-casing forming a protective bank of the general type, which is disclosed in EP 496 519, is shown. In an outer casing 14, two inner casings 15, 15' are arranged, each of which is filled with water. In the earlier known hose-casing, the entire bottom side of the outer casing 14 is applied in abutment against the ground. Contrary to this, a draining unit 12" is inserted under the bottom side of the outer hose-casing, the width of which is, preferably, though not necessarily, larger than half the width of the outer casing 14, but always smaller than the entire width of the casing. This means that a certain part 11" of the bottom side of the casing will be abutting and sealing against the surface. If seepage water would pass in under this sealing surface part 11", the draining unit 12" guarantees that seepage water quickly is drained away in the direction of the dry side of the protective bank.

Figure 6:
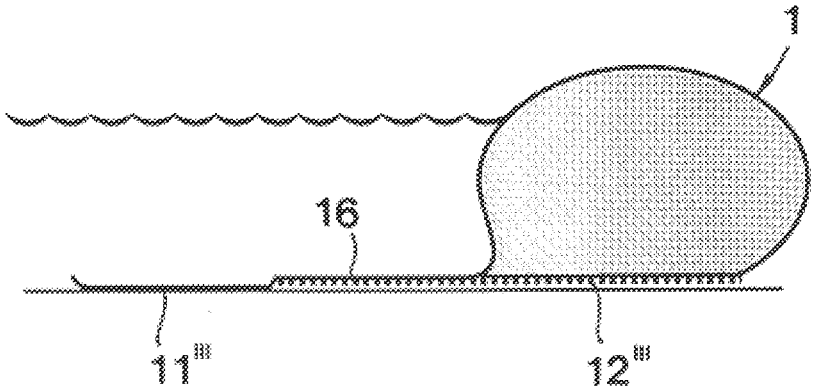

In FIG. 6 an embodiment is shown, according to which a refillable hose-casing 1 has been supplemented by a flexible skirt 16 on its long side edge turned towards the flood side. In this case, a draining unit 12"' extends not only along the entire width of the hose-casing 1, but also a bit in under the skirt 16. However, the skirt 16 abuts along a section 11"' directly against the ground, this section sealing against the surface. Of course the skirt 16, in this case, consists of a material, e.g. geomembrane, which does not allow water to pass through, and the skirt is impermeably connected to the hose-casing 1 itself.

Figure 7:
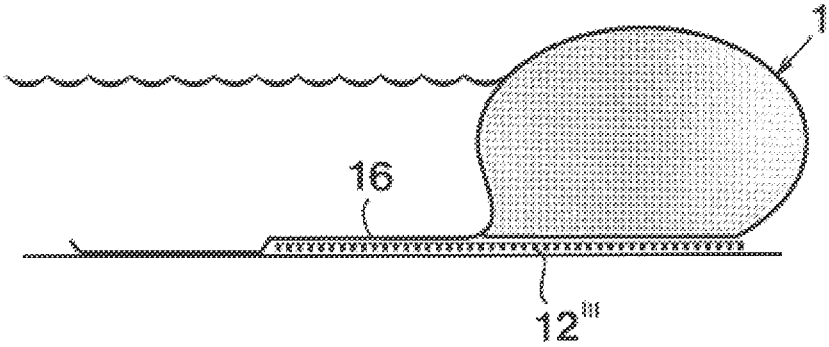

In all the embodiments described above, the draining unit 12 has been shown integrated with those hose-casings commonly forming a protective bank, i.e. the draining unit is always accompanying the individual hose-casing. However, within the scope of the method according to the invention, it is also conceivable to apply a separate draining unit under the hose-casing in question, which is placed on the surface before the hose-casing is deployed and filled with water. This is possible irrespective of whether the hose-casing involves or lacks a skirt of the type shown in FIG. 6. Thus, in FIG. 7 it is illustrated how a draining unit 12"' can be used without being connected to a hose-casing and a skirt thereto respectively.

Figure 8:
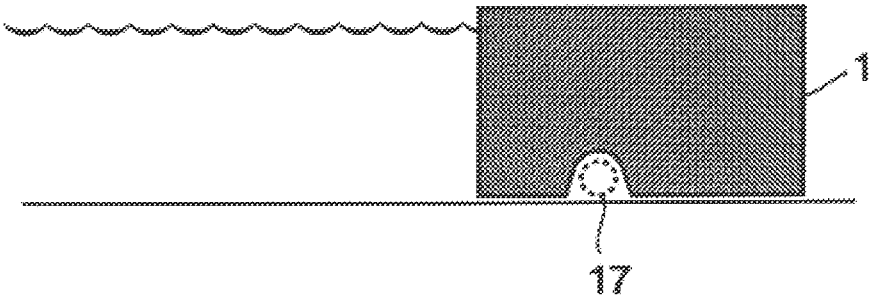

FIG. 8 illustrates how a pipe 17 may serve as draining means instead of the large-area units described above. At the bottom face of an arbitrary damming device 1, e.g. a hose-casing, a recess is formed which houses a pipe or tube with perforated holes through which possible seepage water from the flood side may be let in and diverted away centrally in the axial direction of the bank. As may be clearly seen in FIG. 8, the pipe or hose pipe 17 is suitably located between the two opposite long side edges of the damming device 1, preferably closer to the flood side than the dry side, the area between the draining pipe and the dry side of the damming device being kept "dry" or at atmospheric pressure in that occurring seepage water do not reach this part of the surface.

Feasible Modifications of the Invention

The invention is not limited solely to the embodiments described above and shown in the drawings. Thus, it is conceivable to apply the invention also to other protective banks than those comprising one or more hose-casings which can be filled with water. The invention may, e.g., be used in association to protective banks of the type PORTADAM or similar banks which includes a membrane-like skirt adjacent to a mechanical framework.

I claim:

1. In a liquid-retaining protective bank having a barrier member for damming a liquid, said barrier member being adapted to abut a substrate surface, said protective bank having a first long side edge and an opposed second long side edge turned towards a dry side of the protective bank, the improvement comprising draining means between said substrate and said barrier member, said draining means extending axially along said protective bank and being adapted to drain flood liquid leaking under said barrier member from said first side edge, and for keeping the area on the bottom side of said barrier member extending from said long side edge of said draining means substantially at or about atmospheric pressure to thereby obtain a maximum pressure differential in relation to hydraulic pressure of said liquid, the hydraulic pressure being adapted to keep said protective bank sealed against said substrate surface.

2. The protective bank according to claim 1, wherein said draining means comprises a large-area mat having channels between top and bottom sides through which liquid may pass in a direction away from said long side edge of said member towards said opposite side, said draining means holding a portion of said protective bank lying thereabove at a level above said substrate surface.

3. The protective bank according to claim 1, wherein said draining means comprises a large-area mat having voids between top and bottom sides through which liquid may pass in a direction away from said long side edge of said member towards said opposite side, said draining means holding a portion of said protective bank lying thereabove at a level above said substrate surface.

4. The protective bank according to claim 1, wherein said draining means comprises a large-area board having channels between top and bottom sides through which liquid may pass in a direction away from said long side edge of said member towards said opposite side, said draining means holding a portion of said protective bank lying thereabove at a level above said substrate surface.

5. The protective bank according to claim 1, wherein said draining means comprises a large-area board having voids between top and bottom sides through which liquid may pass in a direction away from said long side edge of said member towards said opposite side, said draining means holding a portion of said protective bank lying thereabove at a level above said substrate surface.

6. The protective bank according to claim 2, wherein said draining means is permanently attached to said protective bank member.

7. The protective bank according to claim 1, said protective bank including damming devices having skirts protruding in the direction of a flood side of said bank, and wherein said draining means has a width larger than the width of said damming device, said draining means partly projecting under said skirts.

8. In a method for forming a liquid-retaining protective bank having a barrier member abutting against a substrate, said protective bank having a first long side edge turned towards a flood side and an opposite second long side edge turned towards a dry side of the protective bank, the improvement comprising applying drainage means between the surface and said member and which extends axially along said bank to drain away liquid leaking under said drainage means from a liquid side of said protective bank so as to keep the area on the bottom side of the member extending from the long side edge of the draining means closest to the liquid side to the dry side, substantially at or about atmospheric pressure in order to obtain a maximum pressure differential in relation to a hydraulic pressure of said liquid, said hydraulic pressure being adapted to keep the protective bank sealed against the surface.

9. In a damming device for erecting a protective bank according to claim 1, in which said barrier member comprises a flexible, elongate casing having means for filling and emptying an anchoring liquid therein and therefrom, the improvement wherein said casing has, along its length, at least three different sections, at least two of said sections forming base sections of said protective bank and being arranged in juxtaposition on said substrate surface, and a third section positioned over and between said base sections when said casing is filled with said liquid; and flexible connecting means associated with said sections for keeping said sections connected, said connecting means permitting liquid flow between connected sections; and at least one base section including means on a bottom side to drain liquid leaking under said base section adjacent said substrate surface.

10. The damming device according to claim 9, wherein an individual section of said casing has a partially round cross-section, said connecting elements extending in a substantially triangulated configuration between portions of said casing.

11. The damming device according to claim 9, wherein one of said base sections includes means for improving the impermeability between said section and said substrate surface.

* * * * *